US005879239A

United States Patent [19]

Macroglou

[11] Patent Number: 5,879,239

[45] Date of Patent: Mar. 9, 1999

[54] ALIGNMENT DEVICE AND METHOD FOR ALIGNING

[76] Inventor: Christopher N. Macroglou, 24 Home Ave., Carnegie, Pa. 15106

[21] Appl. No.: 936,587

[22] Filed: Sep. 24, 1997

[51] Int. Cl.[6] ..... A63B 69/36

[52] U.S. Cl. ..... 473/209; 473/210; 473/215; 473/220; 473/267; 473/409

[58] Field of Search ..... 473/209, 210, 473/267, 220, 215, 409; 362/259

[56] References Cited

U.S. PATENT DOCUMENTS

| | | | |
|---|---|---|---|
| D. 246,655 | 12/1977 | Van Horn . | |
| 1,980,101 | 11/1934 | Schneider . | |
| 3,156,211 | 11/1964 | Mallory . | |
| 3,953,034 | 4/1976 | Nelson . | |
| 4,307,885 | 12/1981 | Pidock . | |
| 4,789,159 | 12/1988 | Kane . | |
| 5,207,429 | 5/1993 | Walmsley et al. | 473/220 |
| 5,388,831 | 2/1995 | Quadri et al. | 473/220 |
| 5,435,562 | 7/1995 | Stock . | |
| 5,464,221 | 11/1995 | Carney . | |
| 5,464,222 | 11/1995 | Carney . | |
| 5,465,972 | 11/1995 | Cornett . | |
| 5,467,992 | 11/1995 | Harkness . | |
| 5,494,290 | 2/1996 | Stefanoski . | |
| 5,544,888 | 8/1996 | Pellegrini . | |
| 5,560,607 | 10/1996 | Macroglou . | |
| 5,725,440 | 3/1998 | Finney | 473/220 |
| 5,788,588 | 8/1998 | Hooker | 473/220 X |

*Primary Examiner*—George J. Marlo
*Attorney, Agent, or Firm*—Bartony Hare & Edson

[57] ABSTRACT

The present invention provides a device and method for assisting a person in achieving proper alignment. The device and method are particularly useful for achieving proper alignment for a golf stroke in which a golf ball is struck to move towards a target. In one embodiment, the device comprises a support member to be worn by the person. A light source is attached to the support member. The light source is adapted to generate a generally linear, visible alignment beam of light on the ground in front of the person when the person is in position to perform a task. The alignment beam is generally parallel to an alignment of the portion of the person's body upon which the support member is worn and, thus, provides an indication of such alignment readily visible to the user in real time.

10 Claims, 7 Drawing Sheets

ALIGNMENT DEVICE AND METHOD FOR ALIGNING

FIELD OF THE INVENTION

The present invention relates to a device for improving alignment, and particularly to a device for assisting a person in determining proper alignment with a target using a projected planar beam of light.

BACKGROUND OF THE INVENTION

It is widely believed that proper initial body alignment and initial club face alignment are essential to a consistent and effective golf stroke. Proper alignment is thought to be critical in both the full swing and putting.

For example, a number of studies have indicated that improper initial alignment results in subconscious compensation during the full swing and the putting stroke. For example, golfers that consistently align to the right of the target have been found to compensate for such alignment by developing a "pull" putting stroke that starts the ball rolling to the left of their actual alignment. Thus, poor alignment generally results in poor stroke mechanics. See Pelz, D., "The First Fundamental of Putting," *GOLF Magazine*, 146 (June 1995).

In developing proper alignment in a putting stroke, it is generally believed that the eyes of the golfer should be aligned generally parallel to the target line and either be inside of or directly over the target line. During the full swing, it is believed that the golfer's body and eyes should be aligned generally parallel to the target line.

It is also widely accepted that it is nearly impossible to recognize and develop proper alignment simply by practicing on the course or range. A number of devices have thus been developed to provide feedback to the golfer to allow the golfer to recognize proper alignment. For example, laser alignment putting aids are available. Such device, however, are relatively expensive. Less expensive, "alignment tracks" are also available but are often cumbersome to use and transport.

It is, therefore, very desirable to develop a device for assisting a person, and particularly a golfer, to determine proper alignment that is inexpensive and easy to use.

SUMMARY OF THE INVENTION

The present invention provides a device for assisting a person in achieving proper alignment. In general, the device comprises:

- a support member to be worn by (that is to attach to) the person;
- a light source attached to the support member, the light source generating a visible alignment beam of light on the ground in front of the person that is generally parallel to an alignment of a portion of the person's body upon which the support member is worn.

Preferably, the light source includes a laser and a generally cylindrical lens positioned transversely to the light beam emanating from the laser. The lens creates a planar beam of light which forms the visible alignment beam on the ground. Light sources other than lasers are possible as long as the planar light beam is visible to the user. A planar beam of light can also be generated by orienting a beam of light onto a convex mirrored surface. The light source can be attached to the support member remotely, for example, via a fiber optic cable.

In a preferred embodiment, the present invention provides a device for assisting a golfer in achieving proper alignment for a golf stroke in which a ball is struck to move towards a target, comprising:

- a support member to be worn by the golfer;
- a light source attached to the support member, the light source generating a visible alignment beam of light on the ground in front of the golfer that is generally parallel to an alignment of the golfer's body when the support member is worn by the golfer;
- an alignment member attached to the support member, the alignment member comprising a planar mirrored surface thereon, the position of the alignment member being adjustable to enable positioning of the mirrored surface such that a reflection of the target may be viewed by the eye of the golfer closest to the target.

In this embodiment, the support member preferably comprises eye glass frames. The alignment member is preferably adjustably attached to the frame member to enable positioning of the mirrored surface such that a reflection of the ball and the target may be viewed simultaneously by the eye of the golfer closest to the target.

The present invention also provides a method of determining alignment of a portion of a body. The method comprises the steps of:

- attaching a support member to the portion of the body, the support member having attached thereto a light source, the light source adapted to generate a visible alignment beam of light on the ground that is generally parallel to the alignment of the portion of the body;
- generating the visible alignment beam of light on the ground.

DETAILED DESCRIPTION OF THE INVENTION

Figure 1:
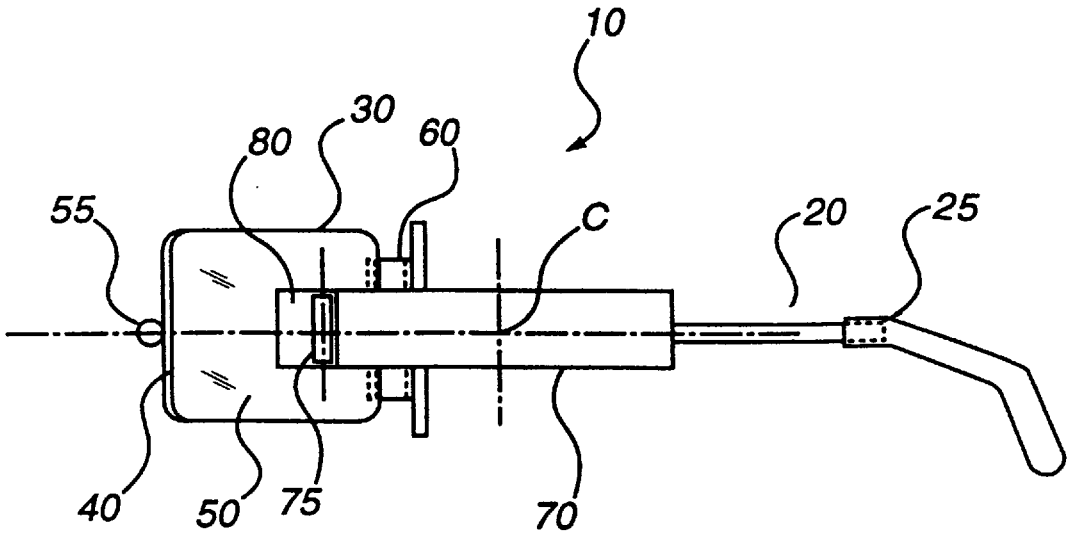
FIG. 1 illustrates a front view of an embodiment of a device of the present invention.
Figure 2:
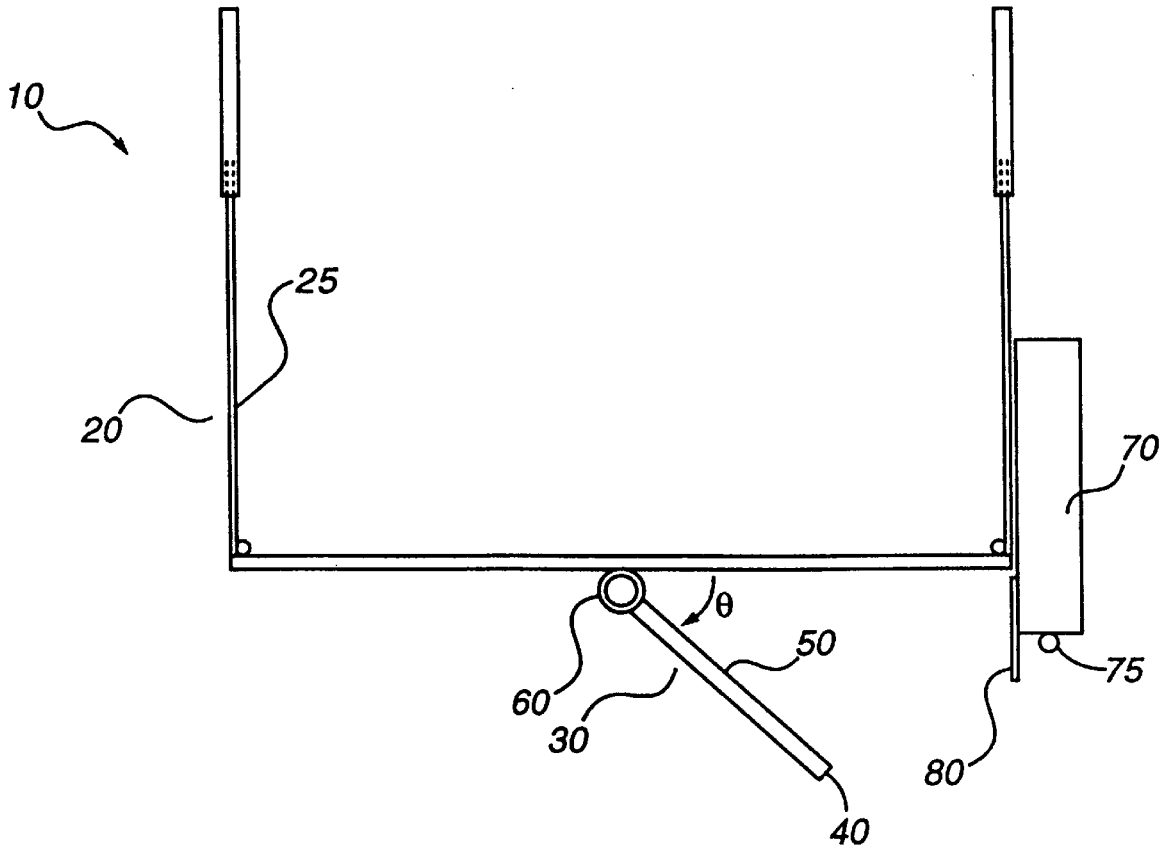
FIG. 2 illustrates a top plan view of the embodiment of FIG. 1.

Referring generally to FIGS. 1 through 4C, one embodiment of a device 10 of the present invention preferably comprises a support member 20 and an alignment member 30 attached to frame member 20. Preferably, frame member 20 comprises eye glass frames as well known in the eye glass arts. Alternatively alignment member 30 can be attachable to the eye glasses of the user via "clip-on" mechanisms as well known in the eye glass arts. Alignment member 30 comprises a planar member 40, having a mirrored surface 50 thereon. Alignment member 30 is preferably adjustably attached to frame member 20 via adjustment member 60 at the bridge of frame member 20. A similar support member and alignment member are disclosed in U.S. Pat. No. 5,560,607, the disclosure of which is incorporated herein by reference.

Device 10 further comprises a light source attached to support member 20. The light source generates a visible alignment line of light A on the ground in front of the golfer that is generally parallel to an alignment of the golfer's eyes when support member 20 is worn by the golfer during putting. In a preferred embodiment, the light source comprises a laser 70 and a generally cylindrical lens 75 positioned transversely to the light beam emanating from laser 70. As known in the optics arts, lens 75 creates a planar beam or fan of light which emanates perpendicular to the axial alignment of lens 75. This planar fan of light forms visible alignment line A on the ground parallel to the orientation of the golfer's eyes.

Preferably, laser 70 is attached to a stem member 25 of glass frame support member 20 such that laser 70 and the laser beam emanating therefrom are generally parallel to the longitudinal orientation of stem member 25. With laser 70 oriented generally parallel to stem member 25, alignment line A will generally appear at a distance in front of the golfer where the golfer's eyes are focused. The orientation of laser 70 can be made adjustable with respect to the orientation of support member 20 to account for individual differences between golfers, however, using adjustment mechanisms known in the art. For example, laser 70 can be rotatable about a point C with respect to stem member 25. The position and orientation of alignment beam A can thereby be adjusted or calibrated for an individual golfer.

To prevent injury to the golfer's eyes, device 10 preferably further comprises a shield 80 that prevents light emanating from lens 75 from directly contacting the golfer's eyes. Alternatively or additionally, support member 20 may include protective eye glass lens to shield the golfer's eyes as known in the laser and optics arts.

During use, a golfer wears device 10 as one would wear standard eye glasses. While the golfer is in his or her putting stance, alignment member 30 is rotated downward so that a golfer can see the target (for example, the golf hole) reflected in mirrored surface 50 out of the eye on the side towards which alignment member 30 is rotated (that is, the eye closest to the target or hole). The vision of the other eye (that is, the eye furthest from the target or hole) is not obstructed by alignment member 30. The user thus has direct, unobstructed vision of the putter head and ball via the eye furthest from the hole (that is, the right eye for a right-handed golfer and the left eye of a left-handed golfer).

Figure 3:
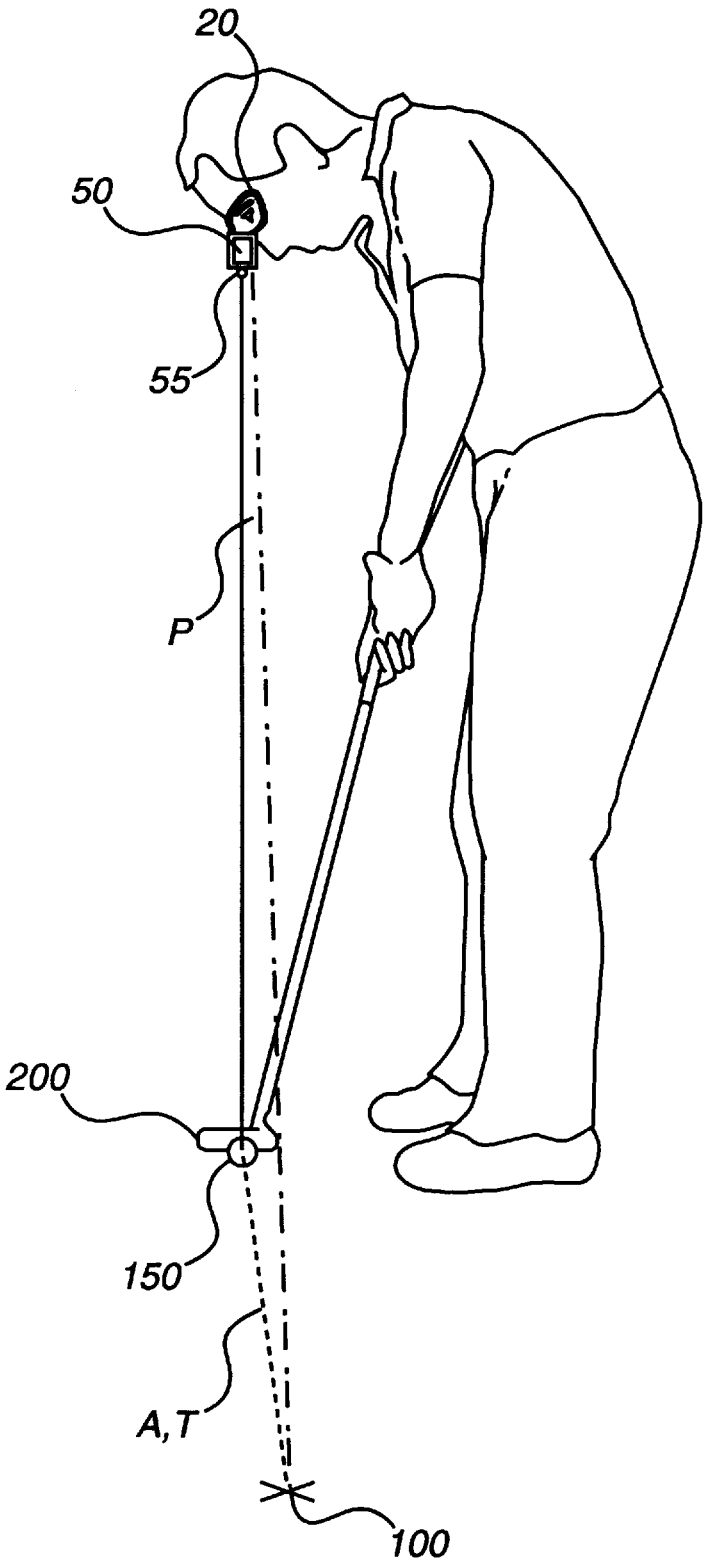
FIG. 3 illustrates the device of FIG. 1 in use by a golfer.
Figure 4A:
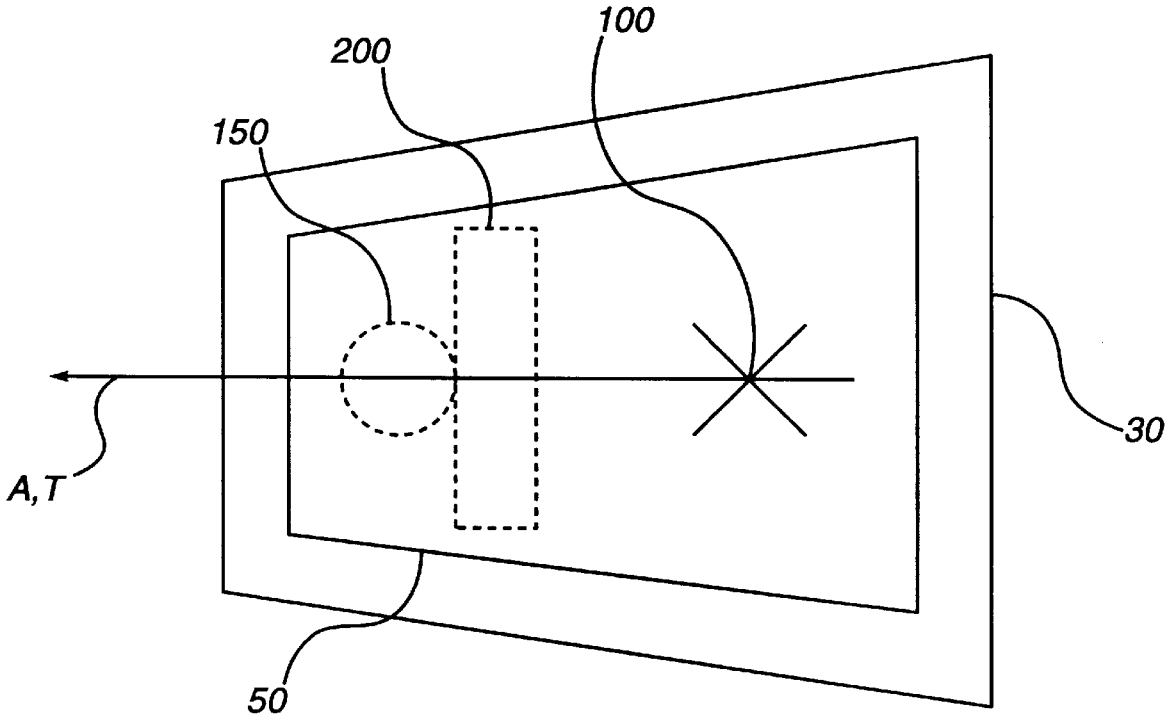
FIG. 4A illustrates a view out of the eye nearest the target of a golfer using the present device.

Mirrored surface 50 is maintained via adjustment member 60 (for example, a ball joint or hinge) at an appropriate angle θ with respect to vertical (see FIG. 2) such that the reflection of target 100 is seen in the field of vision of the eye nearest the hole. The reflection of target 100 is aligned such that it appears to the golfer to be directly behind ball 150 and putter 200 to place the golfer's eyes parallel to target line T between target 100 and ball 150. As illustrated in FIGS. 3, 4A and 4C, target line T and alignment line A are preferably colinear, at least in the case where the present invention is used while putting.

Device 10 may also comprises means for indicating alignment of the eyes substantially directly over ball 150. For example, a marker 55 may be positioned such that by placing the center of marker 55 directly in the line of sight with ball 150, target 100 and putter 200 the golfer will be assured that the golfer's eyes will be part of target plane P.

Because of differing head shapes, the center of marker 55 is preferably laterally adjustable (that is, in the direction of perpendicular to the target line) with respect to the center of alignment member 30 to facilitate achievement of such alignment. The adjustability may be accomplished, for example, via a linear drive screw mechanism (not shown). Alignment member 30 may also be adjustably attached to frame member 20 to allow rotation in a plane generally perpendicular to the target line to facilitate the desired orientation of alignment member 30 without strained flexing and/or tilting by the user. Such rotatable adjustment may be accomplished, for example, using a modified ball joint allowing rotation only in the planes of interest.

By bending at the waist and tilting the head forward so that marker 55 indicates the desired alignment over ball 150, the base of mirrored surface 50 will be positioned substantially perpendicular to the target line and the target and ball will appear generally in the center of mirrored surface 50 when the golfer's eyes are in proper alignment with the target.

Figure 4B:
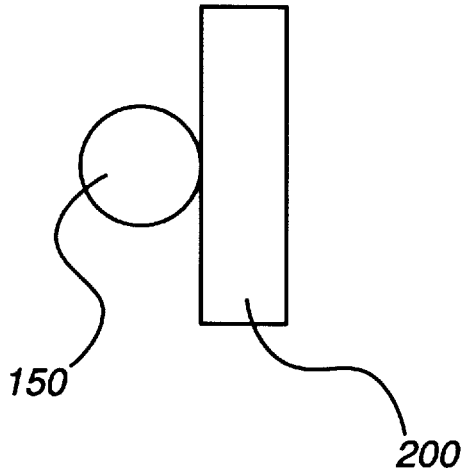
FIG. 4B illustrates a view out of the eye farthest from the target of a golfer using the present device.
Figure 4C:
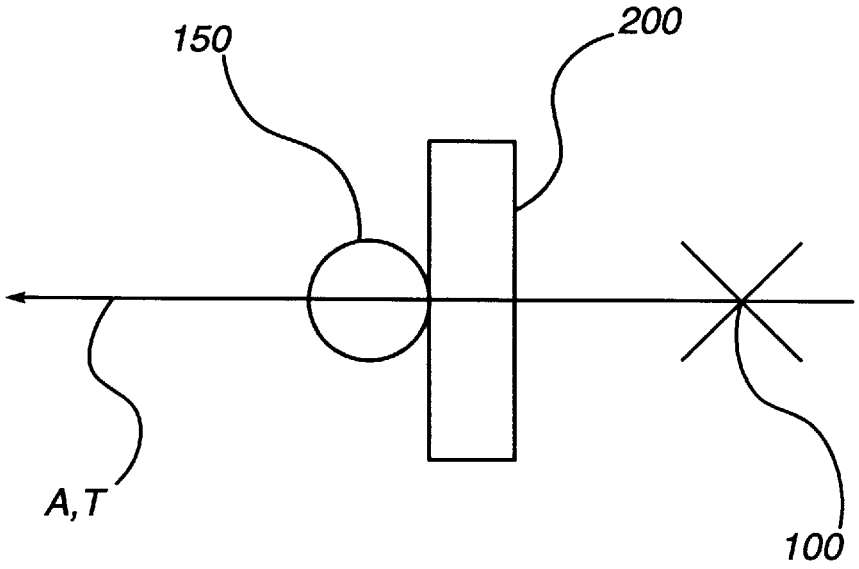
FIG. 4C illustrates the compound or composite view of a golfer using the present device.

The view seen by a golfer using device 10 is best illustrated in FIGS. 4A through 4C. FIG. 4A illustrates the view of the golfer when the eye nearest the target is open and the other eye closed. Putter 200 and ball 150 would not be visible, but are illustrated for reference in broken lines. FIG. 4B illustrates the unobstructed view of putter 200 and ball 150 as seen by the golfer with the eye farthest from the hole open and the other eye closed. FIG. 4C illustrates the "compound" view of the golfer when both eyes are opened. Target 100 appears in mirrored surface 50 which is not shown in FIG. 4C.

While maintaining the head steady, the golfer initiates the backswing and then brings the putter head through the ball on the target line indicated by mirrored surface 50 (and alignment line A). The present device thus provides a teaching aid to assist a golfer in achieving proper alignment during putting. Moreover, the present device also assists the golfer in maintaining the golfer's head steady during putting as any movement of the golfer's head is readily, visibly apparent from the motion of alignment member 30 with relative to the stationary ball.

Figure 5:
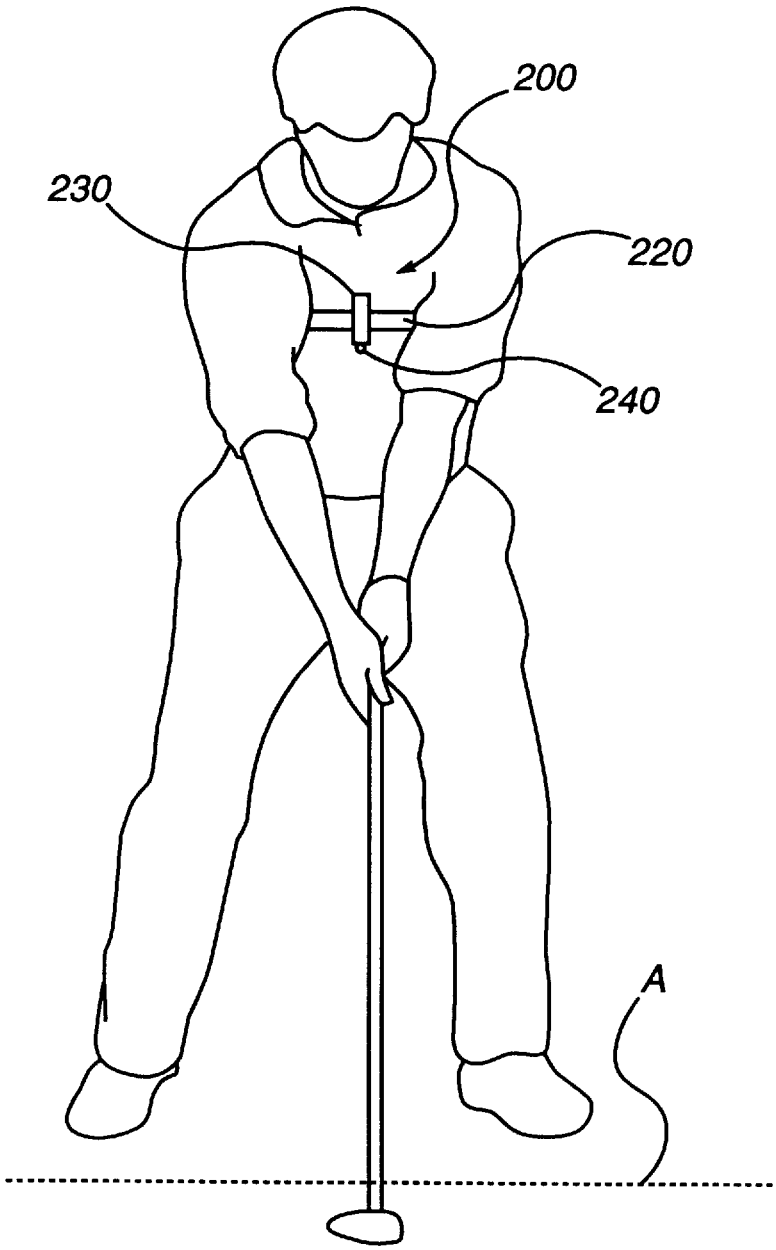
FIG. 5 illustrates another embodiment of a device under the present invention.

Another embodiment of an alignment device 200 of the present invention is illustrated in FIG. 5. In this embodiment, alignment device comprises a support member including a belt member 220 upon which a light source is attached. As described above, the light source generates a visible alignment line of light A on the ground in front of the golfer that is generally parallel to that portion of the golfer's body upon which support member is worn. As also described above, the light source preferably comprises a laser 230 and a generally cylindrical lens 240 positioned transversely to the light beam emanating from laser 230. The light source can be adjustable relative to belt member 220 to enable the user to adjust the position of line A away from the body of the user. Device 200 of FIG. 5 can be worn, for example, on the chest or sternum region to study the alignment of the shoulders and/or on the waist or hip region to study the alignment of the hips. The alignment of device 200 can be checked or calibrate simply by standing against a wall and ensuring that line A is generally parallel to the wall. A switch for turning laser 230 on and off can be located on the laser or remotely.

Although the present invention has been described in detail in connection with the above examples, it is to be understood that such detail is solely for that purpose and that variations can be made by those skilled in the art without departing from the spirit of the invention except as it may be limited by the following claims.

What is claimed is:

1. A device for assisting a person in achieving proper alignment of a portion of the person's body when the person is in position to perform a task, comprising:

a support member to be worn by the person upon the portion of the person's body;

a light source attached to the support member, the light source generating a generally linear, alignment beam of light in front of the person that is generally parallel on a surface visible to the person to provide to the person an indication of an alignment of the portion of the person's body when the person is in position to perform the task, and wherein the support member comprises eye glass frames and the generally linear, alignment beam is generated on the ground in front of the person generally parallel to the alignment of the person's eyes.

2. The device of claim 1 wherein the light source includes a laser and a generally cylindrical lens positioned transversely to a light beam emanating from the laser, the lens creating a planar beam of light which forms the generally linear, alignment beam.

3. A device for assisting a golfer in achieving proper alignment for a golf stroke in which a ball is struck to move towards a target, comprising:

a support member to be worn by the golfer;

a light source attached to the support member, the light source generating a generally linear, visible alignment beam of light on the ground in front of the golfer that is generally parallel to an alignment of the golfer's body when the support member is worn by the golfer and the golfer is in position to strike the ball;

an alignment member attached to the support member, the alignment member comprising a planar mirrored surface thereon, the position of the alignment member being adjustable to enable positioning of the mirrored surface such that a reflection of the target may be viewed by the eye of the golfer closest to the target.

4. The device of claim 3 wherein the support member comprises eye glass frames.

5. The device of claim 4 wherein the alignment member is hingedly attached to the frame member to enable positioning of the mirrored surface such that a reflection of the ball and the target may be viewed simultaneously by the eye of the golfer closest to the target.

6. A method of determining alignment of a portion of a person's body when the person is in position to perform a task, the method comprising the steps of:

attaching a support member to the portion of the person's body, the support member having attached thereto a light source, the light source adapted to generate a generally linear, alignment beam of light on a surface visible to the person to provide to the person an indication of the alignment of the portion of the person's body when the person is in position to perform the task;

generating the generally linear, visible alignment beam of light on the surface.

7. The method of claim 6 wherein the light source comprises a laser and a generally cylindrical lens positioned transversely to a light beam emanating from the laser, the lens creating a planar beam of light which forms the generally linear, visible alignment beam of light .

8. The method of claim 6 further comprising the step of using the alignment beam of light to align for a golf stroke.

9. The method of claim 6 wherein the support member comprises eye glass frames and the generally linear, visible alignment beam is generated upon the ground in front of the person to be generally parallel to the alignment of the person's eyes.

10. The method of claim 6 wherein the support member comprises a belt to be worn around the portion of the person's body.

* * * * *